US005758669A

United States Patent [19]

Taniguchi et al.

[11] Patent Number: 5,758,669

[45] Date of Patent: Jun. 2, 1998

[54] TOBACCO FILTERS AND PRODUCTION PROCESS THEREOF

[75] Inventors: Hiroki Taniguchi; Kanae Nishimura, both of Himeji, Japan

[73] Assignee: Daicel Chemical Industries, Limited, Osaka, Japan

[21] Appl. No.: 726,352

[22] Filed: Oct. 4, 1996

[30] Foreign Application Priority Data

Oct. 5, 1995 [JP] Japan ..... 7-286511

[51] Int. Cl.[6] ..... A24D 3/04

[52] U.S. Cl. ..... 131/340; 131/331; 131/341; 131/336; 131/338

[58] Field of Search ..... 131/341, 336, 131/360, 331, 365, 262, 338, 340

[56] References Cited

U.S. PATENT DOCUMENTS 4,033,361 7/1977 Horsewell et al. ..... 131/262

5,180,765 1/1993 Sinclair ..... 524/306

5,453,144 9/1995 Kauffman ..... 156/213

*Primary Examiner*—Aaron J. Lewis

*Assistant Examiner*—Charles W. Anderson

*Attorney, Agent, or Firm*—Cushman Darby & Cushman IP Group of Pillsbury Madison & Sutro LLP

[57] ABSTRACT

Water disintegratability of a tobacco filter is improved by incorporating a super absorbent resin into a tobacco smoke filter medium in a tobacco filter comprising a main constitutive element of the tobacco smoke filter medium, and a water-soluble polymer as a binder for shaping the constitutive element. The constitutive element includes particulate or fibrous cellulose and cellulose esters (e.g. cellulose acetate). The water-absorption ratio of the super absorbent resin is about 10 to 1,000 times, and the amount of the resin is about 0.05 to 50 parts by weight relative to 100 parts by weight of the main constitutive element of the tobacco smoke filter medium.

13 Claims, No Drawings

TOBACCO FILTERS AND PRODUCTION PROCESS THEREOF

FIELD OF THE INVENTION

This invention relates to a tobacco filter which, if discarded into the environment after smoking, is readily disintegrated or dispersed by rain water or the like, and a production process of the tobacco filter.

BACKGROUND OF THE INVENTION

The tobacco filter comprising a cellulosic non-woven fabric or a fiber bundle of a cellulose ester fiber as a main constitutive element of a tobacco smoke filter medium is in broad use for the purpose of removing the tars form tobacco smoke and yet preserving or keeping the taste and palatability of the smoke.

In the production of such a tobacco filter comprising a bundle of a cellulose ester fiber, a plasticizer (e.g. triacetin, triethylene glycol diacetate, triethylene glycol dipropionate, dibutyl phthalate, dimethoxyethyl phthalate, triethyl citrate, etc.) is commonly used as a binder for shape retention of the filter plug and for insuring the firmness or hardness necessary for cutting out filter tips from the plug.

In the filter plug formed with the aid of such a plasticizer, the filaments have been partly fused together by the plasticizer. Thus, the plasticizer plays the role of a binder interbonding the cellulose ester filaments at random locations at contact points of the filaments. As a consequence, when the cigarette butt is discarded, it takes a long time for the filter plug to disintegrate itself, doing aesthetic harm to the environment and adding to the pollution problem.

Japanese Patent Application Laid-open No. 24151/ 1981 (JP-A-56-24151) discloses a filter comprising a cellulose acetate fiber and a hot-melt or temperature-sensitive adhesive fiber bonding the acetate fiber at points of intersection. As the hot-melt adhesive fiber, a fibrillated polyolefin or equivalent fiber is employed and its proportion to the cellulose acetate fiber is 25 to 50% by weight. This filter is substantially not disintegrated in water because the cellulose acetate fiber is three-dimensionally or nodally bonded at a multiplicity of points of intersection by the hot-melt adhesive fiber.

Japanese Patent Application Laid-open No. 75223/ 1975 (JP-A-50-75223) corresponding to U.S. Pat. No. 411,117 describes a technology for manufacturing a tobacco filter which comprises bonding a cellulose ester fiber with an adhesive composition composed of a high-boiling polyol and a water-soluble or water-dispersible polymer which is soluble in the polyol as selected from the group consisting of polyesters, polyamides and polyesteramides.

WO 93/24685, directed to a biodegradable tobacco filter comprising a cellulose ester fiber and a photo-sensitive metal oxide, describes a filer rod (tobacco filter) comprising a fiber bundle integrated with a water-soluble binder and a water-soluble adhesive for fixing or adhering a wrapping paper with wraps the fiber bundle.

Japanese Patent Application Laid-open No. 75542/ 1995 (JP-A-7-75542) discloses a process which comprises adding a water-soluble polymer in the form of an aqueous solution or particle, to a bundle (tow) of cellulose ester fiber, with the amount of any water used being controlled within 25 parts by weight relative to 100 parts by weight of the fiber bundle, and wrapping the treated fiber bundle in wrapping paper to give a filter rod.

Satisfactory disintegration of these tobacco filters would not be expected when exposed to a usual rainfall fall, although a comparatively rapid disintegration would be expected when it is thrown in a large quantity of water or exposed to an extremely strong rainfall. Moreover, as it is dried again, the water-soluble binder bled to the surface of the filter forms a firm coating or film, and hence it might seriously harm the disintegratability of the filter.

Japanese Patent Application Laid-open No. 115270/ 1987 (JP-A-62-115270) discloses a tobacco filter comprising a filter tip disposed in the tobacco side and containing a super absorbent resin, and a conventional filter tip disposed in the mouth side for the purpose of inhibiting increase of smoking concentration in the latter stage of smoking, and keeping a constant smoking concentration. This literature mentions that a crimped acetate fiber is desirable as the filter material. The tobacco filter described in the literature, however, is directed to improvement of smoking quality, and hence water disintegratability would not be expected. In particular, the filter is produced using a crimped acetate fiber so that the disintegratability is not satisfactorily high.

SUMMARY OF THE INVENTION

It is, therefore, an object of the present invention to provide a tobacco filter which disintegrates itself in contact with not only a large quantity of water but also a small amount of water, and, even if discarded into the environment after smoking, will not do aesthetic harm to the environment and a process for manufacturing the same.

It is another object of the present invention to provide a tobacco filter which has excellent wet disintegratability and disintegrates itself even with a small amount of water with certainty, and a process for manufacturing the same.

The inventors of the present invention did great deal of research to accomplish the above-mentioned objects, and, as a result, found that in a tobacco filter wherein a main constitutive element of a tobacco smoke filter medium of a tobacco filer is shaped with the use of a binder, the combination use of a water-soluble polymer and a super absorbent resin (high-water-absorbable resin) as the binder insures effective utilization of cubic expansion power (force) of the super absorbent resin formed on contact with water for the disintegration of the filter, and hence provides easy or ready disintegration of the tobacco filter on contact with even a small amount of water. The present invention has been accomplished based on the above findings.

Thus, the tobacco filter of the invention is a tobacco filter comprising a main constitutive element of a tobacco smoke filter medium, and a water-soluble polymer for shaping the constitutive element, wherein the tobacco smoke filter medium comprises a super absorbent resin.

The tobacco filter of the invention also includes a tobacco filter comprising a tobacco smoke filter medium composed of a cellulose ester fiber, a water-soluble polymer for shaping the fiber into a rod-shaped fiber bundle, and a particulate super absorbent resin scattered in the rod-shaped fiber bundle.

Such tobacco filter may be manufactured by a step of shaping the main constitutive element of the tobacco smoke filter medium into a rod using a water-soluble polymer and a super absorbent resin.

DETAILED DESCRIPTION OF THE INVENTION

The main constitutive element of the tobacco smoke filter medium is not particularly limited as far as insuring puffing and not remarkably deteriorating smoking quality or other properties of the filter, and a constitutive element in the form of a particle or fiber (particulate or fibrous filter material), in particular at least a fibrous constitutive element can preferably be employed. As the material for the constitutive element, there may be mentioned, for example, polysaccharides or their derivatives (e.g. a cellulose, a cellulose ester, chitin, chitosan, etc.), synthetic polymers (e.g. polyester, polyurethane, polyamide, polyethylene, polypropylene and other polyolefins, etc.), inorganic substances (e.g. a ceramic, glass, diatomaceous earth, etc.). The particulate or fibrous constitutive element composed of any of these materials may be used singly or in combination. The preferable material for the constitutive element includes a cellulose and a cellulose ester.

The cellulose may be whichever of a naturally-occurring cellulose or a regenerated cellulose. Thus, the cellulose includes, for instance, wood fibers (e.g. wood pulp such as softwood pulp and hardwood pulp), seed fibers (e.g. linter and other cotton, bombax cotton, kapok, etc.) and other celluloses derived from vegetables (plants), a bacteria cellulose and other naturally-occurring celluloses; viscose rayon, cuprammonium rayon, nitrate rayon (nitrate silk) and other regenerated celluloses. These celluloses may be employed singly or in combination.

The cellulose in the form of a fiber may be fibrillated. The fibrillation technology of the cellulose is not critical and, by way of illustration, such fibrillation can be achieved in a conventional manner such as beating a raw material for cellulose inclusive of a wood pulp with a beating means such as a beating machine. The degree of beating of the wood pulp may be such that a Canadian standard freeness value, i.e. a freeness value measured by means of a Canadian freeness tester (Canadian standard tester), in the range of about 100 to 800 ml, and preferably about 150 to 700 ml. Further, such fibrillated cellulose may be refined by allowing an impact force to act on the fibrillated cellulose.

The morphology (shape) and size of the cellulose may liberally be selected from broad ranges respectively, such as from a continuous fiber as regarded to have a substantially infinite length, through a fibrous cellulose having a length of about a few millimeter to a few centimeter (a cellulose short staple), to a fine powder having a particle size of about a few micrometer. The particle size of the powdery cellulose may for example be a mean particle size of about 0.1 to 600 μm, preferably about 10 to 500 μm, and more preferably about 20 to 250 μm. The fiber diameter and fiber length of the fibrous cellulose are, for instance, a fiber diameter of about 0.01 to 100 μm, and preferably about 0.1 to 50 μm, and a fiber length of about 50 to 3,000 μm and preferably about 100 to 2,000 μm.

The cellulose ester mentioned above includes, for example, cellulose acetate, cellulose butylate, cellulose propionate and other organic acid esters; cellulose acetate propionate, cellulose acetate butylate, cellulose acetate phthalate, cellulose nitrate acetate and other mixed acid esters; and a polycaprolactone-grafted cellulose ester and other cellulose ester derivatives. These cellulose esters may be employed alone or in combination.

The average polymerization degree (viscosity-average polymerization degree) of the cellulose ester may for instance be about 50 to 900 and preferably about 200 to 800. The average substitution degree of the cellulose ester may be selected in the range of about 1.5 to 3.0, typically speaking. Cellulose esters with average substitution degrees in the range of about 1 to 2.15 can advantageously be used for promoting biodegradation.

The preferred cellulose ester includes organic acid esters (e.g. esters with organic acids each having about 2 to 4 carbon atoms), such as cellulose acetate, cellulose propionate, cellulose butylate, cellulose acetate propionate and cellulose acetate butylate, among which cellulose acetate is particularly desirable. While the degree of acetylation of cellulose acetate is generally within the rage of about 43 to 62%, those species with acetylation degrees in the range of about 30 to 50% are highly biodegradable. Therefore, the degree of acetylation of the cellulose acetate can be selected from the range of about 30 to 62%.

Among these constitutive elements, cellulose esters, in particular cellulose acetate, are preferably employed.

The cellulose ester may practically contain a whitening agent such as a titanium oxide, preferably an anatase-form titanium oxide. The average particle size of the titanium oxide is, for example, about 0.1 to 10 μm, and preferably about 0.2 to 5 μm. The proportion of the titanium oxide to the whole cellulose ester is generally about 0.05 to 2.0% by weight, preferably about 0.1 to 1% by weight, more preferably about 0.2 to 0.8% by weight and practically about 0.4 to 0.6% by weight.

The morphology (shape) and size of the particulate cellulose ester can be selected from a broad range, such as from a pellet having a diameter of about a few millimeter, through a fiber or a flake, to a fine powder having a particle size of about a few micrometer. The particle size (mean particle size) of the particulate cellulose ester is, about 0.1 to 500 μm and preferably about 1 to 300 μm, typically speaking.

The fineness of the fibrous cellulose ester is about 1 to 16 deniers, preferably about 1 to 10 deniers and more preferably about 2 to 8 deniers. The cellulose ester fiber may be whichever of a crimped fiber or a non-crimped fiber. The degree of crimping of the crimped fiber is, for instance, about 5 to 75 crimps per inch (linear inch), preferably about 10 to 50 crimps per inch and more preferably about 15 to 50 crimps per inch. The degree of crimping of the fiber may practically be about 20 to 50 crimps per inch, and a homogeneously crimped fiber can advantageously be used as the crimped fiber. When applied to a tobacco filter, the use of a crimped fiber provides a filter rod having an adequate pressure drop (degree of puff resistance) and inhibited channelling can be obtained.

Incidentally, the use of a crimped fiber as a constitutive element of a tobacco smoke filter medium usually tends to deteriorate the wet disintegratability. According to the present invention, however, the use of such crimped fiber does not interfere with the wet disintegratability since the super absorbent resin is employed in combination with the water-soluble polymer.

The cross-sectional configuration of the cellulose ester fiber is not particularly restricted but may for example be circular, elliptical or any other configuration. Thus, the fiber may be of modified cross-section (e.g. Y-, X-, I-, R- or H-configuration) or hollow.

The fiber bundle (tow) of the cellulose ester fiber can be obtained by bundling about 3,000 to 1,000,000 monofilaments, preferably about 5,000 to 100,000 monofilaments, of cellulose ester fiber. Practically, about 3,000 to 100,000 continuous monofilaments are bundled.

For the purpose of improving the degradability (disintegratability), a water-soluble polymer is used as a binder for the shaping of the constitutive element in the present invention. The constitutive element (e.g. the above-mentioned fiber) may practically be shaped into a rod form by menas of the water-soluble polymer. The term "water-soluble polymer" is used in this specification to include water-dispersible polymers in its broad sense. The water-soluble polymer (water-soluble adhesive) can be used in a liquid form, e.g. an aqueous solution or dispersion, or in a solid form, e.g. powder, or even in the form of a melt. The type of the water-soluble polymer is not particularly limited but may for example be a natural polymer, a semi-synthetic polymer or a synthetic polymer.

The water-soluble natural polymer includes, among others, various polysaccharides (e.g. wheat starch, corn starch, potato starch, tapioca starch, sweet potato starch and other starches, konjak mannan, yeast mannan and other mannans, funori, agar, alginic acid salts inclusive of sodium alginate, carrageenin and other water-soluble polymers of the seaweed origin, tragacanth gum, gum arabic, hibiscus, locust bean gum, guar gum, pectin and other mucilaginous substances of the vegetable origin, dextran and other mucilaginous substances of the microbial origin), and animal and plant proteins (e.g. glue, gelatin, casein, collagen, hyaluronic acid, etc.).

Examples of the semi-synthetic polymer include various cellulose derivatives such as carboxymethyl cellulose and its salt (e.g. carboxymethyl cellulose sodium), hydroxyethyl cellulose, hydroxypropyl cellulose, cellulose acetate with an average degree of acetylation in the range of about 0.3 to 1, methyl cellulose, ethyl cellulose, cellulose sulfate, etc., modified starches and starch derivatives (e.g. solubilized starch, pre-gelatinized starch, dextrin and roast dextrin, oxidized starches such as dialdehyde starch etc., thin boiling starch, starch ethers such as carboxymethylether starch, starch esters, crosslinked starch, etc.).

As the synthetic polymer, there may be mentioned for example poly(vinyl alcohol), polyvinylpyrrolidone, poly (vinyl ether), copolymers of vinyl monomers with a copolymerizable monomer having a carboxyl or sulfo group (sulfonic acid group) or a salt thereof and other water-soluble vinyl polymers, water-soluble acrylic polymers, poly(alkylene oxide)s, water-soluble polyesters and water-soluble polyamides.

The water-soluble polymer includes a hot-melt adhesive polymer (water-soluble hot-melt adhesive) which develops an adhesive power on melting-solidification. The water-soluble polymer of this type (water-soluble hot-melt adhesive) includes those polymers showing hot-melt adhesiveness, among the polymers mentioned hereinbefore, as represented by poly(vinyl alcohol), poly-(ethylene oxide), polyesters, polyamides and acrylic polymers.

These water-soluble polymers can be used singly or in combination. Further, the water-soluble polymer may be employed in whichever form of a solution, dispersion, particle (powder or granule), fiber and the like.

The amount of the water-soluble polymer can be selected from a range as far as insuring the shaping, according to the species, configuration and size of the main constitutive element of the tobacco smoke filter medium, and is, for example, about 0.1 to 50 parts by weight, preferably about 1 to 25 parts by weight and more preferably about 3 to 15 parts by weight relative to 100 parts by weight of the constitutive element such as the fiber bundle.

A feature of the present invention, in one aspect, resides in the combination use of the water-soluble polymer and super absorbent resin to remarkably improve disintegratability of a tobacco filter on contact with water. The species of the super absorbent (high-water-absorbable) resin having high absorption property with respect to water is not critically limited, but those species which can swell by water-absorption can preferably be used. The super absorbent resin includes, for instance, crosslinked or non-crosslinked resins each having a hydrophilic group (e.g. a salt of carboxyl group, sulfonic acid group and other acidic group, or a hydroxyl group), such as a crosslinked polyacrylate-series resins, isobutylene/malate-series resins, starch/polyacrylate-series resins, methyl acrylate/vinyl acetate copolymer-series super absorbent resins, poly-(vinyl alcohol)/polyacrylate-series resins, hydrolyzate-series resins of acrylonitrile fiber, crosslinked poly-(vinyl alcohol)-series resins, starch/polyacrylonitrile hydrolyzate-series resins, crosslinked carboxymethyl cellulose salt-series resins and so on. These super absorbent resins may be used alone or in combination.

The absorption ratio (water-absorption magnification) of the super absorbent resin is at least 10 times relative to the dead weight of the resin on weight basis. The absorption ratio of the super absorbent resin will be preferable if it is as great as possible. Thus, the upper limit of the absorption ratio is not particularly restricted, but upper limit of the absorption ratio of super absorbent resins now on market is about 1,000 weight times. Therefore, the absorption ratio of the super absorbent resin is, for example, about 10 to 1,000 times, preferably about 25 to 1,000 times, and more preferably about 50 to 1,000 times (e.g. about 100 to 800 times) on weight basis. The use of a super absorbent resin having a small absorption ratio may fail to insure significant improvement of the disintegratability of a tobacco filter because of its small swelling degree due to water-absorption.

The super absorbent resin may be used in whichever of various forms such as powder, granule, fiber or others, but may practically be used in the form of a particle (e.g. powder or granule having a mean particle size of about 1 μm to 2 mm, preferably about 2 μm to 1 mm and more preferably about 5 μm to 0.5 mm).

The proportion of the super absorbent resin may be selected from a range according to the form or absorption ratio of the super absorbent resin, and is, for instance, about 0.05 to 50 parts by weight, preferably about 0.1 to 25 parts by weight, more preferably about 0.5 to 10 parts by weight and practically about 1 to 10 parts by weight relative to 100 parts by weight of the main constitutive element of the tobacco smoke filter medium.

For the purpose of enhancing disintegratability of the tobacco filter, the super absorbent resin is contained in the tobacco smoke filter medium (e.g. a rod-shaped fiber bundle). The super absorbent resin may be present in whichever of various forms in the tobacco smoke filter medium, and in many cases, it is dispersed in the fiber bundle (tow). The super absorbent resin may be dispersed or scattered heterogeneously in the fiber bundle, but it may practically be dispersed homogeneously. The super absorbent resin dispersed in the fiber bundle may be in the form of fiber, but it may practically be in the form of a powder or granule, in particular a powder.

Among the super absorbent resins as mentioned above, there are those species which develop adhesive power by means of water-absorption and drying. Such super absorbent resins may be used as a part of the water-soluble polymer as the binder.

The tobacco filter of the invention, where the constitutive super absorbent resin absorbs water even in a small amount and hence the resin swells to a great extent while holding water, insures preservation of wetness of the water-soluble polymer. Accordingly, the filter, even with a small amount of water, insures remarkable decrease of adhesive power of the water-soluble polymer with respect to the constitutive element of the tobacco smoke filter medium, and hence provides disintegration of the tobacco smoke filter medium due to a stress caused by cubical expansion of the super absorbent resin.

Thus, the tobacco filter may only comprise the main constitutive element of the tobacco smoke filter medium (e.g. a particulate or fibrous filter material), the water-soluble polymer for the shaping of the constitutive element into a rod form, and the super absorbent resin in the rod-shaped article. When the constitutive element is a fiber, the fiber may be elongated over the whole length along with the longitudinal direction of the tobacco filter (filter rod).

When a fibrous element (e.g. a tow constituting a fiber bundle) is used as the main constitutive element of the tobacco smoke filter medium, at least one filter tip may preferably be used as a constitutive element of the tobacco filer having a predetermined length, which filter tip is obtainable by cutting a filter rod into a width of 5 mm or less (e.g. about 1 to 5 mm, preferably about 2 to 4.5 mm and more preferably about 2.5 to 4 mm) along with the longitudinal direction, and such filter rod is obtainable by formation (shaping) by means of e.g. rolling up. By way of illustration, when a tobacco filter with a length of 25 mm is intended to provide, the tobacco filter may be produced by cutting a filer rod composed of a fiber bundle into a length of 5 mm, and arranging 5 resultant filter tips in series. When the tobacco filter is composed of a single or plural filter tips, the interlacing degree between fibers per filter tip may be decreased, and hence disintegratability can further be improved.

In the tobacco filter of the invention, the tobacco smoke filter medium may only have a pressure drop (puff resistance) and density in the ranges not adversely affecting the characteristics of the filter. The pressure drop of the tobacco smoke filter medium is, for example in a filter having a length of 10 cm and diameter of 7.8 mm, about 200 to 600 mm WG (mm water gauge, mm $H_2O$) and preferably about 300 to 500 mm WG, and the density is, for instance, about 0.20 to 0.50 g/cm$^3$, and preferably about 0.25 to 0.45 g/cm$^3$ (e.g. about 0.30 to 0.45 g/cm$^3$), in many cases. Such tobacco smoke filter medium insures effective utilization of expansion power (swelling power) of the super absorbent resin due to water-absorption for disintegration of the filter medium.

The tobacco filter of the invention can be manufactured by shaping the main constitutive element of the tobacco smoke filter medium with the use of the super absorbent resin, and the water-soluble polymer as a binder into a rod form. The shaping into a rod form can be carried out by, for example, wrapping up the constitutive element. By way of an example, the tobacco filter may be produced by, while adding the water-soluble polymer and super absorbent resin to the constitutive element, wrapping up the treated element with a wrapping paper into a rod. Further, the tobacco filter may also be manufactured by adding the water-soluble polymer to the main constitutive element of the tobacco smoke filter medium, once shaping the resultant mixture into a paper-like sheet, and, while adding the super absorbent resin to the sheet, wrapping up the treated sheet in a wrapping paper into a rod. Moreover, the filter may be manufactured by adding the water-soluble polymer and super absorbent resin to the main constitutive component of the tobacco smoke filter medium, once shaping or molding the treated element into a paper-like sheet, and wrapping up the sheet directly into a rod.

When a tow of fiber (fiber bundle) is employed as the main constitutive element of the tobacco smoke filter medium, the tobacco filter may be wrapped up by the following processes, typically speaking.

(1) When the water-soluble polymer is employed in a liquid form such as an aqueous solution or dispersion:

The filter may be manufactured by a process which comprises the steps of adding a liquid water-soluble polymer to a fiber bundle (tow) in a predetermined amount, and adding a particulate super absorbent resin to the element, wrapping up the resultant mixture in a wrapping paper, removing off excess water or solvent by drying or other technology to develop adhesive power and hence to form a rod form (tobacco filter). The addition of the super absorbent resin may be carried out in any stage, i.e. simultaneously with the addition of the liquid water-soluble polymer, or before or after the addition of the liquid water-soluble polymer. As the solvent for the liquid water-soluble polymer, there may be mentioned, for instance, water, hydrophilic organic solvents (e.g. methanol, ethanol, isopropanol and other alcohols, cellosolve or equivalents, carbitols, acetone and other ketones, dioxane, tetrahydrofuran and other ethers) or mixtures of these solvents. Practical use may be made of water and/or an alcohol, among which at least water can preferably be employed as the solvent.

(2) When the water-soluble polymer and super absorbent polymer both in a particle form are employed:

The tobacco filter can be obtained by a process comprising the steps of adding the particulate water-soluble polymer and particulate super absorbent resin to a fiber bundle (tow), adding water or a mixture of water and a hydrophilic organic solvent in a predetermined proportion to the treated tow, wrapping up the resultant in a wrapping paper and removing off excess water or organic solvent to develop adhesive power for the shaping of a rod (tobacco filter).

(3) When the water-soluble polymer having hot-melt property is employed:

The tobacco filter may be obtained by a process which comprises the steps of adding the water-soluble polymer and super absorbent resin both in a powder form to a fiber bundle (tow), wrapping up the treated bundle in a wrapping paper, heating and melting the powdery water-soluble polymer and cooling and solidifying the resultant to develop adhesive power for the formation of a rod (tobacco filter).

When a fiber is used as a constitutive element of the tobacco smoke filter medium in these processes, the water-soluble polymer and super absorbent resin may practically be added to an opened tow (fiber bundle). The width of opening of the fiber bundle may be selected in the range of, for example, about 5 to 50 cm.

The constitutive element (e.g. a cellulose ester) of the tobacco smoke filter medium, and the tobacco smoke filter medium itself may further contain a various additive, such as kaolin, talc, diatomaceous earth, quartz, calcium carbonate, barium sulfate, titanium oxide, alumina and other fine powders of inorganic substances; salts of alkali metals, salts of alkaline earth metals and other thermal stabilizers; colorants; oils; yield improvers; activated carbon and other adsorbents. Further, the environmental degradation of the filter can be increased by incorporating an environmental degradation accelerator (biodegradation accelerator) such as citric acid, tartaric acid and malic acid and/or a photodegradation accelerator such as anatase-form titanium oxide.

The tobacco filter according to the present invention where the water-soluble polymer and super absorbent resin are employed in combination and the super absorbent resin rapidly swells due to water-absorption on contact with water so that it insures excellent water-disintegratability.

Therefore, even if it is discarded in the environment after smoking by mistake, the filter rapidly and surely disintegrates itself on contact with even a small amount of rain water or the like and hence is effective for integrity of aesthetic aspect of the environment.

According to the process of the invention, the constitutive unit of the tobacco smoke filter medium is shaped with the combination use of the water-soluble polymer and super absorbent resin, so that a tobacco filter having excellent characteristics as mentioned above can be manufactured with high efficiency, without need of a special apparatus.

The following examples are intended to describe this invention in further detail but should by no means be construed as defining the scope of the invention.

EXAMPLES

Example 1

A 35,000-denier cellulose acetate fiber bundle composed of 5-denier monofilaments was opened to a width of about 25 cm. Onto 100 parts by weigh of the opened fiber bundle were uniformly dusted 7 parts by weight of a powdery poly(alkylene oxide)-series water-soluble hot-melt adhesive resin (Dai-ichi Kogyo Seiyaku Co., Ltd. PAOGEN PP-15), and 3 parts by weight of a powdery cross-linked polyacrylate-series super absorbent resin (Nihon Shokubai Kagaku Kogyo Co., Ltd., ACRYHOPE GH; absorption ratio 200 times) each in a powdery form. The tow was then drawn through a Teflon tube with an inner diameter of 8 mm and the hot-melt adhesive resin in the filter was melted by heating for 120 minutes in an oven at 120° C. After cooling and solidification, the Teflon tube together with the tow was cut to 90 mm in length, and the cut tow was taken out from the tube to give a model sample of a tobacco filter tip without wrapping paper.

Examples 2 to 5

Model samples of tobacco filters were obtained in the same manner as Example 1 except for employing the following super absorbent resins respectively in lieu of the super absorbent resin used in Example 1.

Example 2: An alternating copolymer-series super absorbent resin of isobutylene and maleic anhydride (KURARAY Co., Ltd., KI GEL; absorption ratio 200 times)

Example 3: A starch-acrylic acid graft copolymer-series super absorbent resin (Sanyo Chemical Industries, Ltd., SANWET; absorption ratio 700 times)

Example 4: A methyl acrylate-acetic acid copolymer-series super absorbent resin (Sumitomo Chemical Industries Ltd., IGETAGEL; absorption ratio 300 times)

Example 5: A crosslinked carboxymethyl cellulose salt-series super absorbent resin (Daicel Chemical Industries Ltd., GELFINE; absorption ratio 200 times)

Example 6

A model sample of tobacco filter tip was obtained in the same manner as Example 1, except for employing a powdery poly(vinyl alcohol)-series water-soluble hot-melt adhesive resin (The Nippon Synthetic Chemical Industry Co., Ltd., Japan, HM-602) in lieu of the powdery water-soluble hot-melt adhesive resin used in Example 1.

Examples 7 to 10

Model samples of tobacco filter tips were prepared in the same manner as example 6 except that, in lieu of the super absorbent resin used in Example 1, the following powdery super absorbent resins were used respectively.

Example 7: An alternating copolymer-series super absorbent resin of isobutylene and maleic anhydride (KURARAY Co., Ltd., KI GEL; absorption ratio 200 times)

Example 8: A starch-acrylic acid graft copolymer-series super absorbent resin (Sanyo Chemical Industries, Ltd., SANWET; absorption ratio 700 times)

Example 9: A methyl acrylate-acetic acid copolymer-series super absorbent resin (Sumitomo Chemical Industries Ltd., IGETAGEL; absorption ratio 300 times)

Example 10: A crosslinked carboxymethyl cellulose salt-series super absorbent resin (Daicel Chemical Industries Ltd., GELFINE; absorption ratio 200 times)

Comparative Examples 1 to 3

A 35,000-denier cellulose acetate fiber bundle (tow) composed of 5-denier monofilaments was opened to a width of 25 cm, and, as the binder, 8 parts by weight of the following plasticizer relative to 100 parts by weight of the tow was uniformly dusted over the tow. The tow was then drawn through a Teflon tube with an inner diameter of 8 mm, and the charged tow was allowed to stand for 24 hours or longer and cut to a length of 90 mm. By taking out the charged from the Teflon tube, a model sample of tobacco filter tips without a wrapping paper was provided.

Comparative Example 1: Triacetin

Comparative Example 2: Triethylene glycol diacetate

Comparative Example 3: Triethylene glycol propionate

Comparative Example 4

A model sample of tobacco filter tips without wrapping paper was prepared in the same manner as Example 1, except that the super absorbent resin was not used.

Comparative Example 5

The procedure of Example 6 was repeated to give a model sample of tobacco filter tips without wrapping paper, except that the super absorbent resin was not employed.

The water-disintegratability of the tobacco filter tips obtained in the above Examples 1 to 10 and Comparative Examples 1 to 5 were evaluated. The results are set forth in Table 1. Test samples were subjected to the test after 24 hours of conditioning in an environment controlled at 20° C. and 65% R.H. (relative humidity).

[In water-disintegratability test]

A 25 mm-long filter tip specimen and a 5 mm-long filter tip specimen were respectively placed in a beaker containing 500 ml of water and stirred in such a manner that the height in the center of the vortex would be equal to ¾of the maximum height of liquid level. After 10 minutes, the shape of the filter was visually inspected and rated for disintegratability according to the following criteria.

Excellent: Rapid flocculent disintegration

Good: Local flocculent disintegration

Poor: No disintegration, original shape retained

[Small amount-water-disintegratability test]

A 25 mm-long filter tip specimen and a 5 mm-long filter tip specimen were respectively placed in a petri dish with an outer diameter of about 10 cm, and 10 ml of water was dropped from an end of a buret with a height of about 10 cm, drop by drop, taking 5 minutes in such a manner that a drop of water directly hit the filter tip. The shape of the filter tip immediately after the completion of dropping was inspected visually and the disintegratability was evaluated according to the following criteria.

Excellent: Disintegrated, original shape not recognized

Fair: Highly swelled, local disintegration

Good: Swelled but original shape retained

Poor: Scarce change in shape.

TABLE 1

| | In water-disintegratability Filter tip length | | Small-amount-water-disintegratability Filter tip length | |
|---|---|---|---|---|
| | 25 mm | 5 mm | 25 mm | 5 mm |
| Example 1 | Excellent | Excellent | Fair | Excellent |
| Example 2 | Excellent | Excellent | Fair | Excellent |
| Example 3 | Excellent | Excellent | Fair | Excellent |
| Example 4 | Excellent | Excellent | Fair | Excellent |
| Example 5 | Excellent | Excellent | Fair | Excellent |
| Example 6 | Excellent | Excellent | Fair | Excellent |
| Example 7 | Excellent | Excellent | Fair | Excellent |
| Example 8 | Excellent | Excellent | Fair | Excellent |
| Example 9 | Excellent | Excellent | Fair | Excellent |
| Example 10 | Excellent | Excellent | Fair | Excellent |
| Comp. Ex. 1 | Poor | Poor | Poor | Poor |
| Comp. Ex. 2 | Poor | Poor | Poor | Poor |
| Comp. Ex. 3 | Poor | Poor | Poor | Poor |
| Comp. Ex. 4 | Excellent | Excellent | Good | Fair |
| Comp. Ex. 5 | Excellent | Excellent | Good | Fair |

As apparent from Table 1, the filter tips obtained by using a cellulose acetate plasticizer in Comparative Examples 1 to 3 do not show water-disintegratability, and the filter tips as produced by employing only a water-soluble polymer in Comparative Examples 4 and 5 show excellent disintegratability in water but are insufficient in the disintegratability on contact with a small amount of water. Contrary to this, the filter tips according to Examples exhibit excellent disintegratability on contact with water even in a small amount.

What is claimed is:

1. A tobacco filter comprising a main constitutive element of a tobacco smoke filter medium and a water-soluble polymer for shaping of said constitutive element, wherein said tobacco smoke filter medium comprises a high-water-absorbable resin.

2. A tobacco filter as claimed in claim 1, wherein the water absorption ratio of the high-water-absorbable resin is 10 to 1,000 weight times.

3. A tobacco filter as claimed in claim 1, wherein the content of the high-water-absorbable resin is 0.05 to 50 parts by weight relative to 100 parts by weight of the main constitutive element of the tobacco smoke filter medium.

4. A tobacco filter as claimed in claim 1, wherein said main constitutive element of the tobacco smoke filter medium is a cellulose or a cellulose ester.

5. A tobacco filter as claimed in claim 1, wherein said main constitutive element of the tobacco smoke filter medium is a cellulose acetate.

6. A tobacco filter as claimed in claim 1, wherein said main constitutive element of the tobacco smoke filter medium is a cellulose ester containing an anatase titanium oxide particle.

7. A tobacco filter as claimed in claim 1, wherein said tobacco smoke filter medium mainly comprises a fibrous constitutive element, and said filter is composed of at least one filter tip cut to a length of 1 to 5 mm.

8. A tobacco filter which comprises a tobacco smoke filter medium comprising a cellulose ester fiber, a water-soluble polymer for shaping said fiber into a rod-shaped fiber bundle, and a particulate high-water-absorbable resin scattered in said rod-shaped fiber bundle.

9. A tobacco filter as claimed in claim 8, wherein said particulate high-water-absorbable resin has an average particle size of 1 μ to 2 mm.

10. A tobacco filter as claimed in claim 8, wherein said filter comprises 1 to 25 parts by weight of the water-soluble polymer, and 0.5 to 10 parts by weight of the high-water-absorbable resin having a water-absorption ratio of 25 to 1,000 weight times relative to 100 parts by weight of the fiber bundle.

11. A tobacco filter as claimed in claim 8, wherein said filter comprises 3 to 15 parts by weight of the water-soluble polymer and 1 to 10 parts by weight of the particulate high-water-absorbable resin having an average particle size of 2 μm to 1 mm and a water-absorption ratio of 50 to 1,000 weight times, relative to 100 parts by weight of a cellulose acetate fiber.

12. A process for producing a tobacco filter, which process comprises a step of shaping a main constitutive element or a tobacco smoke filter medium into a rod-form with the use of a water-soluble polymer and a high-water-absorbable resin.

13. A process for producing a tobacco filter according to claim 12, wherein said process is a process selected from the group consisting of:

(i) a process comprising the steps of adding a liquid water-soluble polymer and a particulare high-water-absorbable resin to a fiber bundle, wrapping the treated fiber bundle in wrapping paper and eliminating excess water or solvent;

(ii) a process comprising the steps of adding a particulate water-soluble polymer and a particulate high-water-absorbable resin to a fiber bundle, adding water or a mixed solvent of water and a hydrophilic organic solvent to the treated fiber bundle, wrapping the resultant fiber bundle in wrapping paper and eliminating excess water or organic solvent; and (iii) a process comprising the steps of adding a powdery water-soluble polymer and a powdery high-water-absorbable resin to a fiber bundle, wrapping the treated fiber bundle in wrapping paper, heating and melting the powdery water-soluble polymer, and cooling and solidifying the molten water-soluble polymer.

* * * * *